US005383517A

United States Patent [19]

Dierbeck

[11] Patent Number: 5,383,517

[45] **Date of Patent: * Jan. 24, 1995**

[54] ADHESIVELY ASSEMBLED AND SEALED MODULAR HEAT EXCHANGER

[76] Inventor: Robert F. Dierbeck, 2707 Hall Rd., Hartford, Wis. 53027

[ * ] Notice: The portion of the term of this patent subsequent to Apr. 19, 2011 has been disclaimed.

[21] Appl. No.: 177,178

[22] Filed: Jan. 4, 1994

Related U.S. Application Data

[63] Continuation-in-part of Ser. No. 72,497, Jun. 4, 1993, Pat. No. 5,303,770.

[51] Int. Cl.[6] ..... F28F 9/26; B21D 53/02

[52] U.S. Cl. ..... 165/144; 165/140; 165/148; 165/183; 29/890,03; 29/890.039

[58] Field of Search ..... 165/130, 140, 144, 148, 165/173, 178, 183; 29/890.03, 890.039

[56] References Cited

U.S. PATENT DOCUMENTS

| | | | |
|---|---|---|---|
| 1,962,837 | 6/1934 | Raible | 165/144 X |
| 2,002,763 | 5/1935 | Bair | 165/144 X |
| 2,013,186 | 9/1935 | Price | 165/144 X |
| 2,044,457 | 6/1936 | Young | 165/144 |
| 2,068,236 | 1/1937 | Kuenster | 165/130 |
| 2,083,028 | 6/1937 | Livar | 165/144 X |
| 2,124,787 | 7/1938 | Lachasse | 165/144 |
| 2,343,387 | 3/1944 | Sargent et al. | 165/130 |
| 3,222,764 | 12/1965 | Hansson et al. | 29/890.05 |
| 3,396,785 | 8/1968 | Kirsch | 165/148 X |
| 3,476,178 | 11/1979 | Harting | 165/148 X |
| 3,692,105 | 9/1972 | O'Connor | 165/181 |
| 3,905,850 | 9/1975 | Darm | 29/890.039 X |
| 3,995,688 | 12/1976 | Darm | 29/890.039 X |
| 4,150,719 | 4/1979 | Thielen et al. | 165/140 |
| 4,154,296 | 5/1979 | Fijas | 165/183 X |
| 4,603,460 | 8/1986 | Yano et al. | 29/890.039 |
| 4,687,053 | 8/1987 | Paulus et al. | 29/890.039 X |
| 4,979,560 | 12/1990 | Dierbeck | 165/76 |
| 5,148,863 | 9/1992 | Fouts et al. | 165/144 X |
| 5,195,240 | 3/1993 | Shuster et al. | 29/890.039 |
| 5,274,920 | 1/1994 | Matthews | 29/890.039 |

*Primary Examiner*—John Rivell

*Attorney, Agent, or Firm*—Andrus, Sceales, Starke & Sawall

[57] ABSTRACT

A modular heat exchanger includes unitary finned tubular core elements which can be assembled into a multi-module heat exchanger without any brazed, soldered or welded connections or mechanical connectors. The modules are preferably made from extruded aluminum blocks into which the heat exchanging fins are cut or cold formed and into the ends of which flow accumulating passages are bored. The modules are assembled with a high strength adhesive sealant which simultaneously secures the modules together and seals the peripheries of the bored passages at the module interfaces.

11 Claims, 2 Drawing Sheets

FIG. 1
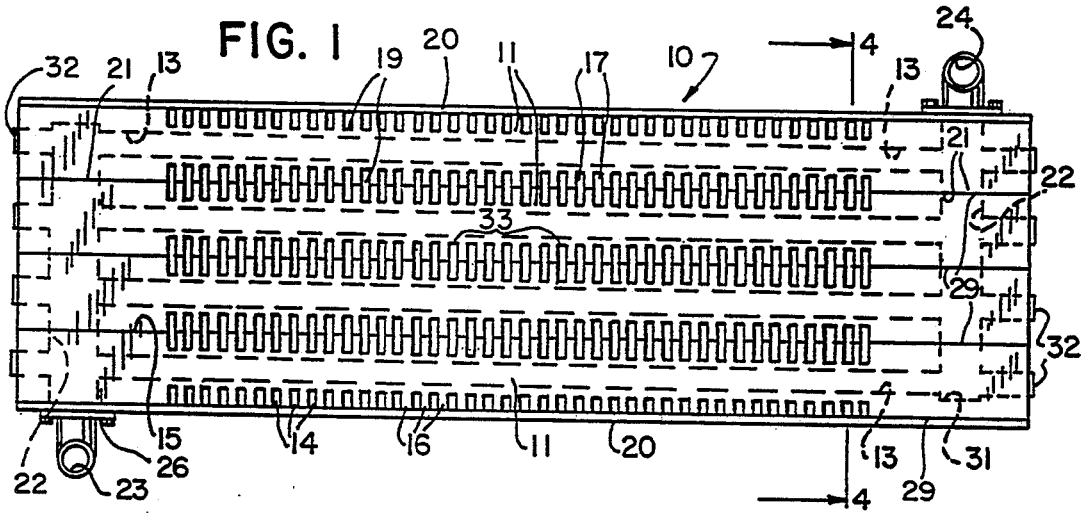
FIG. 2
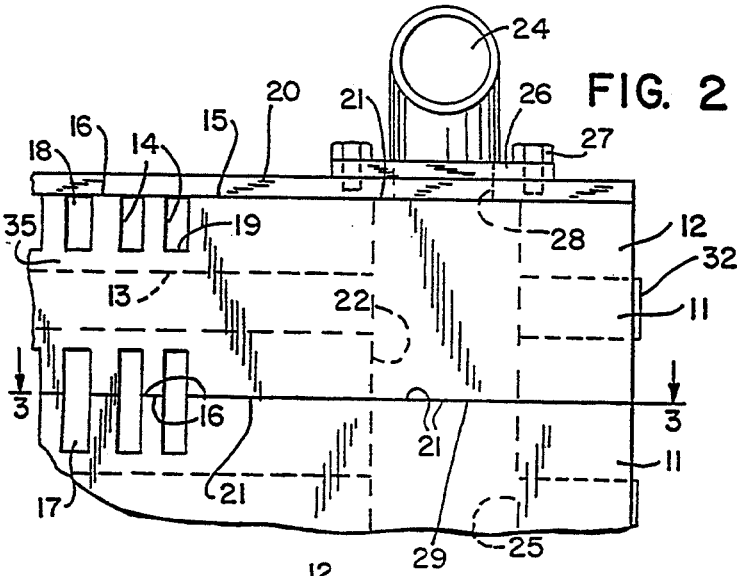
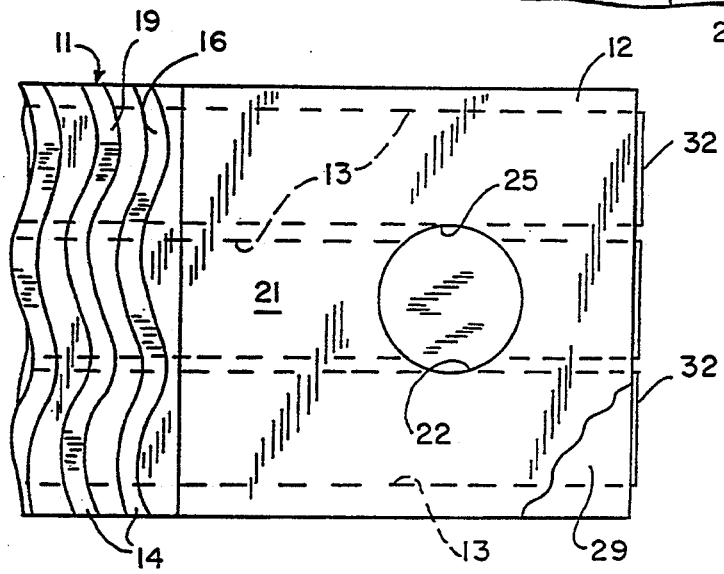
FIG. 3

ADHESIVELY ASSEMBLED AND SEALED MODULAR HEAT EXCHANGER

This application is a continuation-in-part of application Ser. No. 08/072,497, filed Jun. 4, 1993 now U.S. Pat. No. 5,303,770.

BACKGROUND OF THE INVENTION

The present invention pertains to heat exchangers for flowing fluids and, more particularly to a modular heat exchanger in which each of the core modules is formed from a unitary block of a heat exchange material.

Conventional heat exchanger construction of the type particularly adapted for automotive use utilizes heat exchanging core elements which include a series of generally parallel tubular conduits extending between and attached at their opposite ends to inlet and outlet headers. The tubular conduits are typically provided with heat conducting and dissipating fins which may be either of a flat plate or serpentine construction and which are soldered or brazed to the tubular conduits. The conduits, in turn, are also typically soldered or brazed to the headers or to similar fluid accumulating tanks. The rigid soldered or brazed joints have always constituted a common source of heat exchanger failure and, when the heat exchangers are used in automotive applications, repairs usually require removal of the entire radiator and resultant downtime for the automotive equipment. Thus, there has long been a need and desire for a heat exchanger having unitary core elements and one in which brazed or soldered connections can be minimized and, preferably, eliminated completely.

U.S. Pat. No. 3,222,764 discloses various related methods for making unitary finned tubular conduits, suitable for use in heat exchangers, from billets of aluminum or other ductile metals. An aluminum billet with a central through bore is provided with a series of cut grooves on opposite surfaces extending in the direction of the through bore. The billet is then rolled transversely and longitudinally to flatten the ridges forming the grooves and to close the bore. The reduction in thickness of the billet is extreme (to about 1/40 the original billet thickness) and the finned walls originally defining the walls of the cut slots are mechanically peeled back to form a series of parallel upstanding fins. The bore is also reopened to form a unitary finned conduit. Various alternate embodiments of finned tubes are shown, but there is no disclosure of any structure or method for incorporating the same into a modular heat exchanger.

U.S. Pat. No. 3,692,105 also describes a unitary heat exchanger core in which an elongate tubular aluminum member has a series of parallel fins formed thereon by peeling back surface layers in stepwise fashion and turning the peeled layers upwardly to extend perpendicularly from the tubular member. This patent also discloses bending a long section of such a unitary finned tube in a serpentine pattern to form a heat exchanger unit. The construction, however, is not modular.

My own U.S. Pat. Nos. 4,979,560 and 5,042,572 disclose modular heat exchangers of the type having easily replaceable modules and which are suitable for automotive or mobile equipment applications. However, the modules disclosed in these patents are of conventional tube and fin construction or of a corrugated sheet metal construction which require substantial amounts of welding, brazing or soldering to assemble the various components.

In accordance with my co-pending application Ser. No. 08/072,497, filed Jun. 4, 1993, a modular heat exchanger is disclosed which includes unitary finned tubular core elements which can be assembled into a multi-module heat exchanger, including flow distributing headers or end tanks without any brazed, soldered, or welded connections of any kind. The heat exchanger is fully disassemblable in one embodiment, however, mechanical connectors and a substantial number of O-ring seals are required for assembly. In another embodiment, welded or brazed connections may be utilized to provide units which are partially disassemblable. However, these units are potentially subject to the prior art problem of inadequate joint strength and environmentally less desirable materials.

SUMMARY OF THE INVENTION

The modular heat exchanger of the present invention includes a plurality of modules which are formed from elongate extruded aluminum blocks, each of which blocks has a generally rectangular cross section and a longitudinally extending through bore. Each module is formed with a series of parallel fins on opposite faces of the block and extending fully across the respective face, with the fins lying in planes generally perpendicular to the longitudinal axis of the through bore. The outer edge surfaces of the fins on each face lie coplanar with the face in which they are formed. Flat face portions are provided at both ends of each of the opposite faces of the module, which face portions define the ends of each series of fins. A cross bore is provided on each end of the heat exchanger extending perpendicular to and passing through abutting face portions and intersecting the ends of the through bores. An adhesive layer applied to the fact portions secures the modules together in face-to-face contact with the outer edges of the fins on adjacent modules abutting one another. The adhesive layer also seals the abutting face portions around the periphery of each cross bore passage between the face portions.

The present invention also includes a method for making a modular heat exchanger which includes the steps of: forming a plurality of modules from extruded elongate blocks of a heat exchanging material, such as aluminum, each block having a generally rectangular cross section defined by parallel opposite faces and a longitudinally extending through bore; forming a series of parallel spaced slots in the block faces to provide fins on opposite faces of the block between face portions at the ends of each block face, with the fins lying in planes generally perpendicular to the longitudinal axis of the through bore, and the outer edge surfaces of the fins on each face lying coplanar with the face in which the fins are formed; forming cross bore portions in the ends of each block to provide cross bore openings in the end faces in fluid communication with the through bore; applying an adhesive sealant to the face portions; and, placing the modules together in face-to-face contact with the outer edge surfaces of the fins and the face portions on adjacent modules respectively abutting one another and the cross bore portions on each end aligned with one another to simultaneously secure the modules together and seal the cross bore openings.

The fins may be formed in the block faces by cutting or by cold rolling. Use of the latter forming technique requires the additional use of spacer elements to connect and seal the cross bore portions when assembling the heat exchanger.

BRIEF DESCRIPTION OF THE DRAWINGS

FIG. 1 is a front elevation of a heat exchanger using the modular construction of the present invention.

FIG. 2 is an enlarged view of a portion of FIG. 1.

FIG. 3 is a sectional view taken on line 3—3 of FIG. 2.

DETAILED DESCRIPTION OF THE PREFERRED EMBODIMENTS

Figure 4:
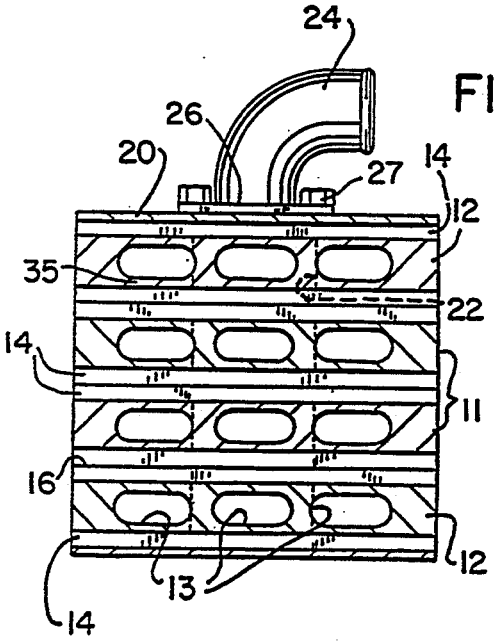
FIG. 4 is a sectional view taken on line 4—4 of FIG. 1.

Referring initially to FIGS. 1–4, a heat exchanger 10 includes a series of identical core modules 11 which, in the heat exchanger shown, comprise four in number. Each module 11 is preferably made from an elongate extruded aluminum block 12 which is generally rectangular in cross section and is formed in the extrusion process with a series of three parallel through bores 13 having flattened or oval cross sections. A series of parallel fins 14 is formed on each of the opposite wider faces 15 of the block 12 to overly the series of through bores 13. The fins 14 are formed to extend generally perpendicular to the axes of the through bores, and the outer edges 16 of the fins lie coplanar with the face 15 in which they are formed.

The heat exchanger 10 is formed by stacking the four modules 11 together in face-to-face contact with the edges 16 of the fins 14 on adjacent modules 11 directly abutting one another. As is best shown in FIG. 2, the modules 11 in the assembled heat exchanger define interior air flow passages 17 between adjacent modules which are two times the height of the fins in length and as wide as the slot 19 between adjacent fins. The heat exchanger is enclosed between a pair of outer mounting plates 20 which abut the outer edges 16 of the fins on the outside faces of the outer modules to define a series of outer air flow passages 18 half the length of the interior air flow passages 17.

The opposite ends of each module on both faces 15 include flat face portions 21 in which no fins are provided. In the assembly of the heat exchanger 10, the face portions 21 are covered with a layer 29 of a suitable high strength adhesive to secure the modules together with the face portions on adjacent modules 11 in face-to-face contact. The outside face portions 21 of the outer modules are similarly adhesively secured to the abutting surfaces of the mounting plates 20 to complete the assembly. The need for tie rods or connecting bolts is eliminated.

A cross bore 22 extends through the modules 11 with its axis centered in the face portions 21 and extending perpendicular thereto. As may best be seen in FIGS. 3 and 4, the cross bore 22 comprises aligned cross bore portions 25 in each of the modules and is sized and positioned to intersect all three through bores 13 in each module 11. Thus in the four-module construction shown in FIGS. 1–4, the cross bore 22 intersects a total of 12 through bores 13. The cross bores 22 on opposite ends of the heat exchanger 10 provide for accumulation of the fluid flow at the inlet and outlet ends 23 and 24 of the heat exchanger. The interfaces between adjacent face portions 21 where the cross bore 22 passes through are sealed around their peripheries to prevent fluid leakage by the adhesive layer 29 used to attach and secure the modules together. The inlet and outlet 23 and 24, respectively, may be provided with flanged connecting plates 26 attached to the outside surfaces of the mounting plates, as with bolts 27, and in fluid communication with the cross bore 22 via openings 28 in the mounting plates 20.

The cross bore 22 may be provided as a blind cross bore by providing one end face of each outer module 11 with a blind cross bore portion 31. However, since the cross bore portions 25 are preferably provided on an individual module basis and to maintain exact identity between the modules, it is preferred to drill all cross bore portions 25 as through bores and to appropriately plug the blind cross bore portions 31 or, preferably, utilize the adhesive layer 29 between the mounting plate 20 and the adjacent face portion 21 to provide the necessary fluid seal. The ends of all of the through bores 13 on the ends of heat exchanger 10 must be plugged, as best shown in FIG. 3. The plugs 32 may comprise permanent welds, elastomer plugs, or preferably aluminum plugs secured in place with the same adhesive used for the layers 29.

Various types of adhesive sealant materials may be utilized to provide the adhesive layer 29 to secure the modules together and also to provide any other adhesive joints or seals, such as to secure the plugs 32 in place. The adhesive must have high strength, low temperature flexibility, high temperature resistance and resistance to the liquids with which it is likely to come in contact. The adhesive must also provide overall flexibility and high weatherability for vehicle applications.

A number of room temperature curable and thermosetting adhesives have been found to be suitable. Examples of room temperature curable adhesives include GE Silicones RTV116, a silicon rubber sealant, and FRV1107, a fluorosilicone adhesive sealant. A suitable thermosetting adhesive is B. F. Goodrich PLASTILOCK 655, a nitrile rubber/phenolic resin adhesive. Other adhesives which provide the necessary and desirable properties may also be used.

Figure 5:
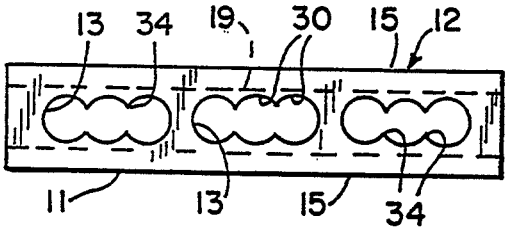
FIG. 5 is an end elevation of an extruded block from which a heat exchanger module is made showing a modified embodiment.

Referring also to FIG. 5, a description of the presently preferred manner of making heat exchanger modules 11 from extruded aluminum blocks 12 will be set forth. Aluminum extrusions including the pattern of three parallel through bores 13 (as shown in FIG. 4) are available in any convenient length from which blocks 12 may be cut to any desired final module length. One size of suitable aluminum extrusion has a rectangular cross section approximately 9/16 inch (1.4 cm) wide and 3-¾ inches (9.5 cm) long. Each of the through bores 13 has an identical oval cross section which is approximately 1/10 inch (0.3 cm) wide and 1-⅛ inch (2.9 cm) long.

The fins 14 are cut into each of the opposite faces 15 of the block 12 using an arrangement of ganged cutting blades having an overall length equal to the desired length of the pattern of fins (i.e. the distance between face portions 21 on opposite ends of the block). In the presently preferred embodiment, each of the blades has a thickness sufficient to provide a slot 19 between the fins 0.047 or 3/64 inch (1.2 mm) in width and the blades are spaced to provide fin thicknesses of 0.025 inch (0.6 mm). The ganged cutting blades are mounted below the horizontal surface of a cutting table and are positioned to extend the blade cutting edges above the surface of the table by an amount sufficient to provide a slot depth and fin height of about 0.21 inch (5.3 mm). Cutting depth must be accurately controlled since the final internal wall thickness between the bottoms of the slots 19 and the long walls of the oval through bores 13 is only 0.015–0.020 inch (about 0.5 mm). Preferably, the aluminum block 12 is pushed through the ganged cutting blades with a suitable ram while the block is held in contact with the cutting table surface with spring-biased rollers in contact with the upper face 15 of the block. After the pattern of fins 14 is cut into one face, the block is turned over and an identical fin pattern is cut into the opposite face.

As shown particularly in FIG. 5, the through bores 13 in the modules 11 may be provided with longitudinally extending ribs 34 to provide the bores with additional surface area for enhanced heat transfer. As shown, the ribs 34 result from a more or less scalloped cross section which is readily produced with appropriate redesign of the tooling used to provide the extruded aluminum blocks 12 from which the modules are constructed. The ribbed cross section may, in effect, comprise a series of overlapping circular bores 30 to produce the ribbed effect shown. In addition and if found to be necessary, transverse protrusions or ribs, in the manner described in my above identified co-pending application, may be provided within the bores 13 to provide more turbulent flow and improved heat exchange capability.

If the size of a heat exchanger requires the use of modules 11 of extended length, for example, greater than 36 inches (about 91 cm) in length, added strength and rigidity may be provided by providing adhesive connection of the modules at their midpoints as well as between the face portions 21 at the opposite ends. For example, and referring to FIG. 1, a center portion 33 of each module may be provided without cut slots 19, thereby leaving flat surface portions to which supplemental adhesive layers may be applied prior to assembly of the heat exchanger. The flat center portions 33 would be provided on the outer faces 15 of the outside modules as well for supplemental adhesive attachment to the mounting plates 20.

Figure 6:
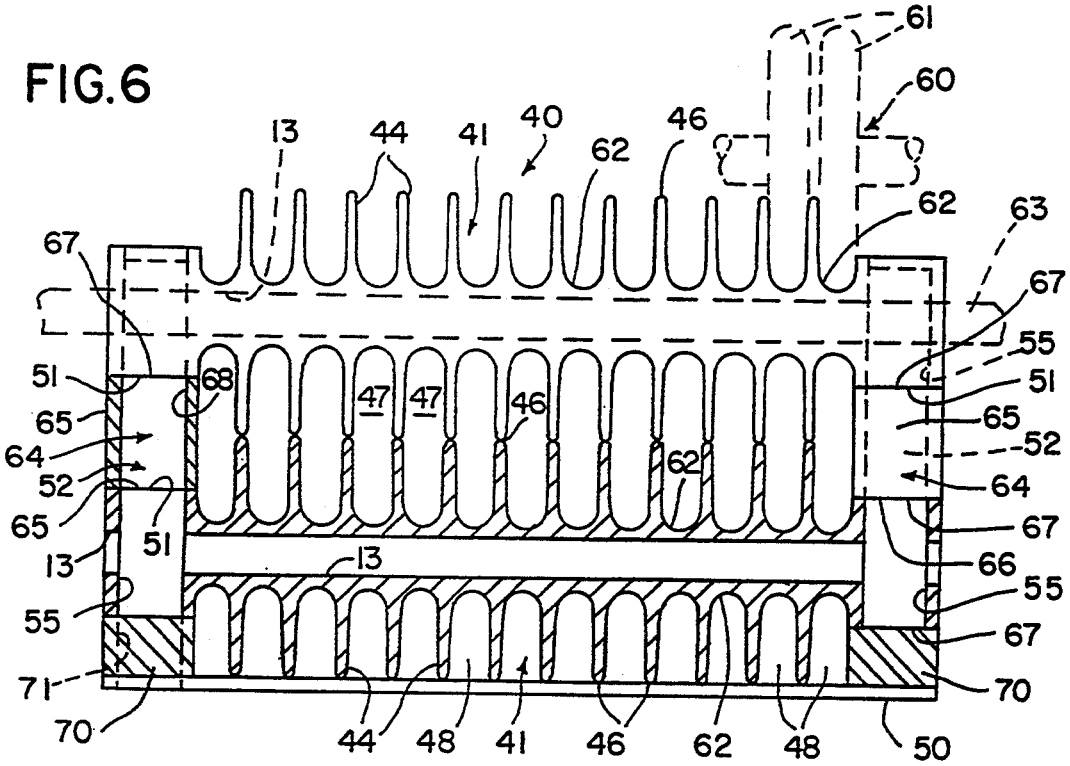
FIG. 6 is a front elevation, partly in sections, of a heat exchanger using another embodiment of a modular construction of the present invention.

Referring to FIG. 6, there is shown a portion of a heat exchanger 40 constructed of modules 41 in which the fins 44 are formed by an alternate method. Each module 41 may be formed from an extruded aluminum block 12 of the previous embodiment which includes a series of through bores 13. However, the fins 44 are cold rolled into the side faces 15 of the block 12, rather than being cut as previously described.

A conventional cold rolling tool 60 may be used, including a series of rotary forming wheels 61, only two of which are shown in phantom. However, a unitary set of ganged forming wheels 61, extending the full length of the module 41 could be utilized. As a result of the cold rolling operation, block material is moved out of the face 15, forming semi-circular depressions 62 therein and resulting fins 44 between adjacent forming wheels 61. To prevent collapse of the through bores 13 during the cold rolling process, solid supporting mandrels 63 are inserted into the bores and removed after the fins are formed. The faces of the forming wheels 61 are slightly tapered, resulting in a slight taper, or draft on the faces of the cold-formed fins 44 so that the forming wheels can be readily removed. The outer edges 46 of the fins are slightly rounded from the cold forming process, but nevertheless allow end-to-end engagement with the fins of an adjacent module to form the interior air flow passages 47 in a manner similar to that described with respect to the embodiment of FIGS. 1–5.

The face portions 21 at the ends of each module 41 are not cold formed and, therefore, remain generally in the plane of the original faces 15 of the aluminum block. However, some movement of face material inevitably occurs and a finishing operation to restore the planar faces 15 would normally be necessary. Because the outer edges 46 of the cold-formed fins 44 extend outwardly beyond the plane of the face portions 51, when modules 41 are brought together to form the heat exchanger, the gap 64 between face portions 51 on adjacent modules must be filled. A spacer block 65 is used for this purpose. The spacer blocks 65 are rectangular in shape and include side faces 66 which abut the module face portions 51 and may be secured thereto with an adhesive layer 67 of the same type described with respect to the previous embodiment. Also in a manner similar the previously described embodiment, a cross bore 52 for accumulating the working fluid at the ends of the heat exchanger 40 comprises cross bore portions 55 in the ends of the modules connected by an aligned spacer block bore 68 of the same diameter.

Where the outside module of the heat exchanger 40 is closed with a suitable mounting plate 50 to form outer air flow passages 48, small spacer blocks 70 are used to interconnect the face portions 51 and the surface of the mounting plate 50. Depending on how the flow of working fluid is to be handled, bores 71 may be formed in the small spacer blocks as well. However, if the flow of working fluid is to pass directly from the heat exchanger via the ends of the through bores 13, the small spacer blocks 70 need to be bored.

A module 41 of the type shown in FIG. 6 may, for example, be formed from an aluminum block having a width of 0.300 inch (7.6 mm), with a corresponding width of the through bores 13 of 0.100 inch (2.5 mm). Utilizing a rolling tool 60 having forming wheels 61 with nominal widths of 0.100 inch and an edge radius between side faces of 0.047 inch (1.2 mm), rolling the faces 15 of the block to a depth of 0.050 inch (1.3 mm) results in a total height of fins 44 of 0.200 inch (5.1 mm). In other words, the fin material is displaced 0.150 inch beyond the plane of the face portions 51.

Various modes of carrying out the present invention are contemplated as being within the scope of the following claims particularly pointing out and distinctly claiming the subject matter which is regarded as the invention.

I claim:

1. A modular heat exchanger for a fluid flow comprising:

a plurality of modules formed from elongate extruded blocks of a heat transfer material, each block having a generally rectangular cross section and a longitudinally extending through bore between parallel opposite planar block faces;

each block face having formed therein a plurality of equally spaced parallel slots extending fully across the face in a lateral direction with respect to the axis of the through bore and defining therebetween a series of parallel fins bounded by face portions at the ends of each block face, the outer edge surfaces of the fins on each face lying coplanar with the face in which the fins are formed, and the outer edges of the fins and the face portions on adjacent modules respectively abutting one another when the modules are placed together in face-to-face contact;

a cross bore perpendicular to and passing through abutting face portions and intersecting said through bores at each end; and, a thin adhesive layer between said abutting face portions sealing the periphery of each cross bore passage therethrough and securing the modules together.

2. The apparatus as set forth in claim 1 wherein the adhesive layer is formed from an adhesive selected from the group consisting of silicone rubbers, fluorosilicone elastomers and nitrile rubber/phenolic resins.

3. The apparatus as set forth in claim 1 wherein the adhesive layer is formed from a room temperature curable adhesive.

4. The apparatus as set forth in claim 1 wherein the adhesive layer is formed from a thermosetting adhesive.

5. The apparatus as set forth in claim 1 wherein each module includes a plurality of parallel through bores the longitudinal axes of which lie in a plane parallel to the block faces.

6. The apparatus as set forth in claim 5 wherein the bores are oblong in cross section.

7. The apparatus as set forth in claim 1 wherein the through bore includes a plurality of longitudinal ribs extending the full length thereof.

8. A method for making a modular heat exchanger for a fluid flow comprising the steps of:

(1) forming a plurality of modules from extruded elongate blocks of a heat transfer material, each block having a generally rectangular cross section defined by parallel opposite block faces and a longitudinally extending through bore;

(2) forming a series of parallel spaced slots in the block faces to provide fins on opposite faces of the block between face portions at the ends of each block face, said fins lying in planes generally perpendicular to the longitudinal axis of the through bore, the outer edge surfaces of the fins on each face lying coplanar with the face in which the fins are formed;

(3) forming cross bore portions in the ends of each block to provide cross bore openings in the end faces in fluid communication with the through bore;

(4) applying an adhesive sealant to the face portions of the modules; and, (5) placing the modules together in face-to-face contact with the outer edge surfaces of the fins and the face portions on adjacent modules respectively abutting one another and the cross bore portions on each end aligned with one another to simultaneously secure the modules together and seal the peripheries of the cross bore openings.

9. The method as set forth in claim 8 including the step of providing the through bore with a plurality of longitudinally extending ribs along the full length thereof.

10. The method as set forth in claim 8 wherein each module block has a plurality of parallel through bores the longitudinal axes of which lie in a plane parallel to the block faces.

11. The method as set forth in claim 10 wherein said bores are generally oval in cross section, and including the additional step of providing each of said bores with a plurality of full length axial ribs.

* * * * *